United States Patent [19]

Rassey

[11] 4,244,338

[45] Jan. 13, 1981

[54] INTERNAL COMBUSTION ENGINE

[76] Inventor: Louis J. Rassey, 15711 12 Mi Rd., Roseville, Mich. 48066

[21] Appl. No.: 934,207

[22] Filed: Aug. 16, 1978

Related U.S. Application Data

[63] Continuation-in-part of Ser. No. 803,051, Jun. 3, 1977, Pat. No. 4,198,946.

[51] Int. Cl.[3] ..... F01L 7/00

[52] U.S. Cl. ..... 123/190 A; 123/51 AA

[58] Field of Search ..... 123/190 A, 190 DL, 190 E, 123/190 BB, 190 BD, 53 AA, 51 A, 51 AA, 190 R

[56] References Cited

U.S. PATENT DOCUMENTS

| | | | |
|---|---|---|---|
| 497,239 | 5/1893 | Grant | 123/190 A |
| 604,415 | 5/1898 | Reardon | 123/51 AA |
| 729,602 | 6/1903 | Kelly | 123/190 A |
| 1,221,094 | 4/1917 | Roth | 123/53 AA |
| 1,224,557 | 5/1917 | McKelvy | 123/190 A |
| 3,608,308 | 9/1971 | Cary | 123/190 A |

FOREIGN PATENT DOCUMENTS

| | | | |
|---|---|---|---|
| 345605 | 3/1931 | United Kingdom | 123/190 A |

*Primary Examiner*—Ronald H. Lazarus

*Attorney, Agent, or Firm*—Gifford, Van Ophem, Sheridan & Sprinkle

[57] ABSTRACT

An internal combustion engine is provided having a housing with a pair of crankshafts rotatably mounted within the housing in a spaced and parallel relationship. One or more throughbores, forming the cylinder for the engine, are provided in the housing between the crankshafts and slidably receive a pair of piston members therein and in a facing relationship, the piston members being connected to their respective crankshafts by connecting rods in the usual manner. A fuel inlet passageway is provided in the housing to supply a fuel air mixture to each cylinder and between the piston members while, similarly, an exhaust passage is provided in the housing to permit the exhaust fumes to be expelled from each cylinder. An inlet rotary valve is positioned within the inlet passageway and includes at least one diametric throughport for selectively opening and closing the inlet passageway in dependence upon the rotational position of the inlet valve. Similarly, an exhaust rotary valve having at least one diametric throughport is positioned within the exhaust passageway in dependence upon the rotational position of the exhaust valve. Both the inlet and exhaust rotary valves are rotatably driven in synchronism with the reciprocation of the piston members within the housing throughbore.

6 Claims, 7 Drawing Figures

INTERNAL COMBUSTION ENGINE

CROSS REFERENCE TO RELATED APPLICATIONS

The present application is a continuation-in-part of patent application Ser. No. 803,051, entitled ROTARY VALVE CONSTRUCTION FOR AN INTERNAL COMBUSTION ENGINE and filed on June 3, 1977, now U.S. Pat. No. 4,198,946.

BACKGROUND OF THE INVENTION

I. Field of the Invention

The present invention relates generally to an opposed piston internal combustion four-cycle engine and, more particularly to such an engine having rotary intake and exhaust valve members.

II. Description of the Prior Art

There have been a number of previously known opposed piston internal combustion engines, mainly for two-cycle operation. In an opposed piston engine, a pair of piston members are slidably disposed in a facing relationship within a single engine cylinder so that the combustion chamber is defined between the heads of the piston members. The piston members reciprocate away from and toward each other in synchronism and, in doing so, provide the driving output from the engine.

Opposed piston engines, however, have not enjoyed widespread commercial success for a number of different reasons. For example, opposed piston four-cycle engines have also presented special difficulties with the valving of both the fuel air mixture into the combustion chamber and the exhausting of the combustion products from the engine cylinder. Previous attempts to adapt poppet valves have proven largely unsuccessful since the poppet valves cannot be positioned above the piston head as in the more conventional internal combustion engines.

The introduction of fuel into the cylinder and the exhaustion of combustion fumes therefrom have presented special problems with opposed piston diesel engines. In such engines the clearance space between the piston heads at maximum compression is too small to enable the use of poppet valves. Consequently, there have been no previously-known opposed piston diesel engines known to Applicant.

SUMMARY OF THE PRESENT INVENTION

The present invention overcomes all the above mentioned disadvantages of the previously known opposed piston engines by providing such an engine having rotary intake and exhaust valves, making four-cycle operation of opposed piston engines practical.

In brief, the opposed piston engine according to the present invention comprises a housing having at least one and preferably more engine cylinders. A pair of pistons are slidably disposed within each engine cylinder and in a facing relationship so that the combustion chamber is defined between the two heads of the piston members and the cylinder wall.

A first engine crankshaft is rotatably mounted within the housing at one axial end of the cylinders while the second crankshaft is also rotatably mounted within the engine housing at the other end of the cylinders so that the crankshafts are spaced and parallel to each other. The piston members are connected to their respective crankshafts so that, upon reciprocation, the pistons rotatably drive the crankshafts. Unlike the previously known opposed piston engines, however, the crankshafts are rotatably connected together, and thus synchronized, by a gearing arrangement rather than by the previously known drive chains. In addition, the crankshafts together rotatably drive a stub drive shaft via a gearing arrangement.

An intake rotary valve is rotatably positioned within the intake passageway to the cylinder combustion chamber while, similarly an exhaust rotary valve is rotatably positioned within the exhaust passageway from the combustion chamber. Each rotary valve includes diametric throughports which selectively open and close their respective passageways in dependence upon the rotational position of the rotary valve. The rotary valves are synchronized with the crankshafts via a gearing arrangement.

BRIEF DESCRIPTION OF THE DRAWINGS

A better understanding of the present invention will be had upon reference to the following detailed description when read in conjunction with the accompanying drawing, wherein like reference characters refer to like parts throughout the several views, in which.

DETAILED DESCRIPTION OF THE PRESENT INVENTION

Figure 1:
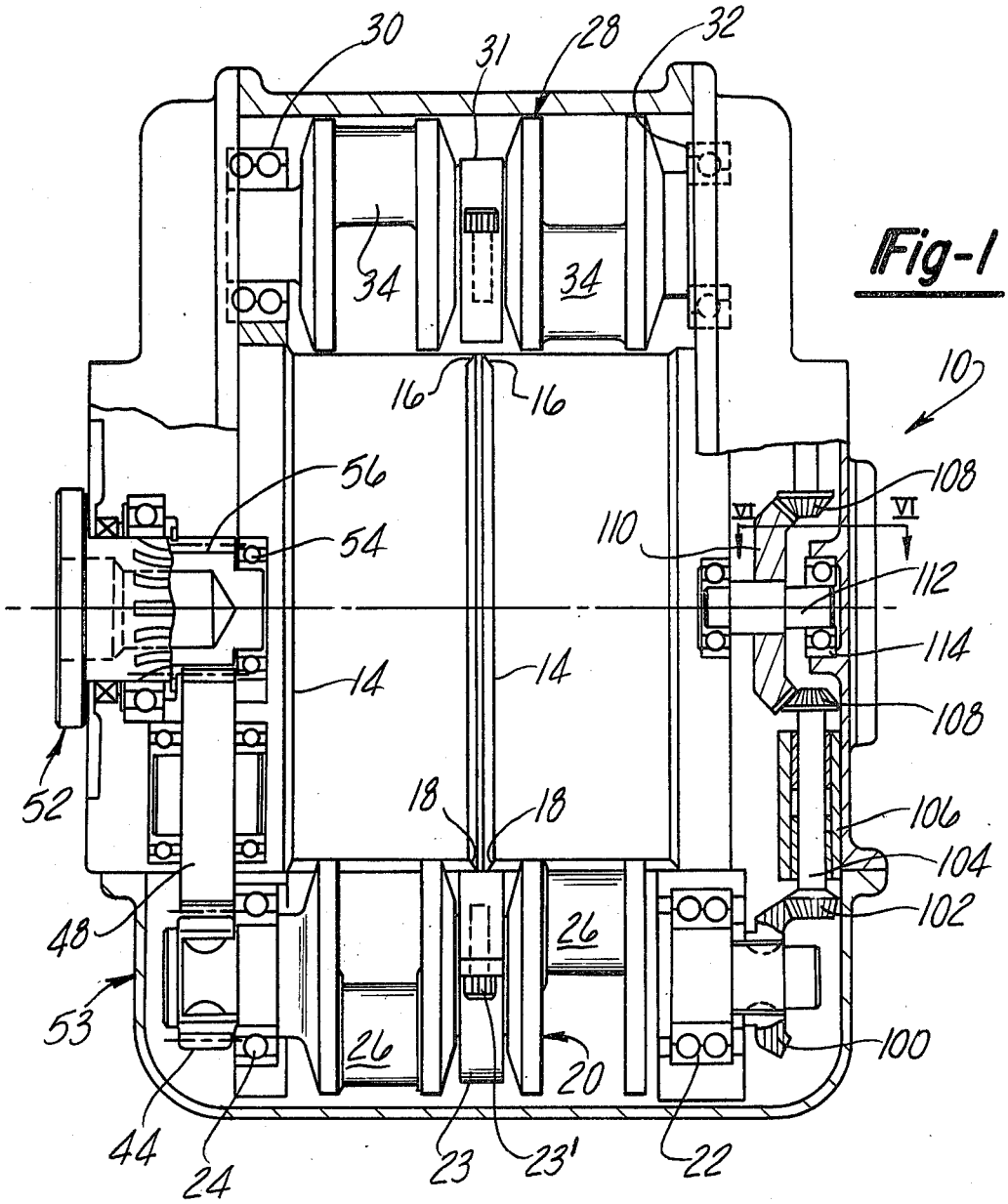
FIG. 1 is a fragmentary plan view of the internal combustion engine according to the present invention and with parts removed for clarity.
Figure 2:
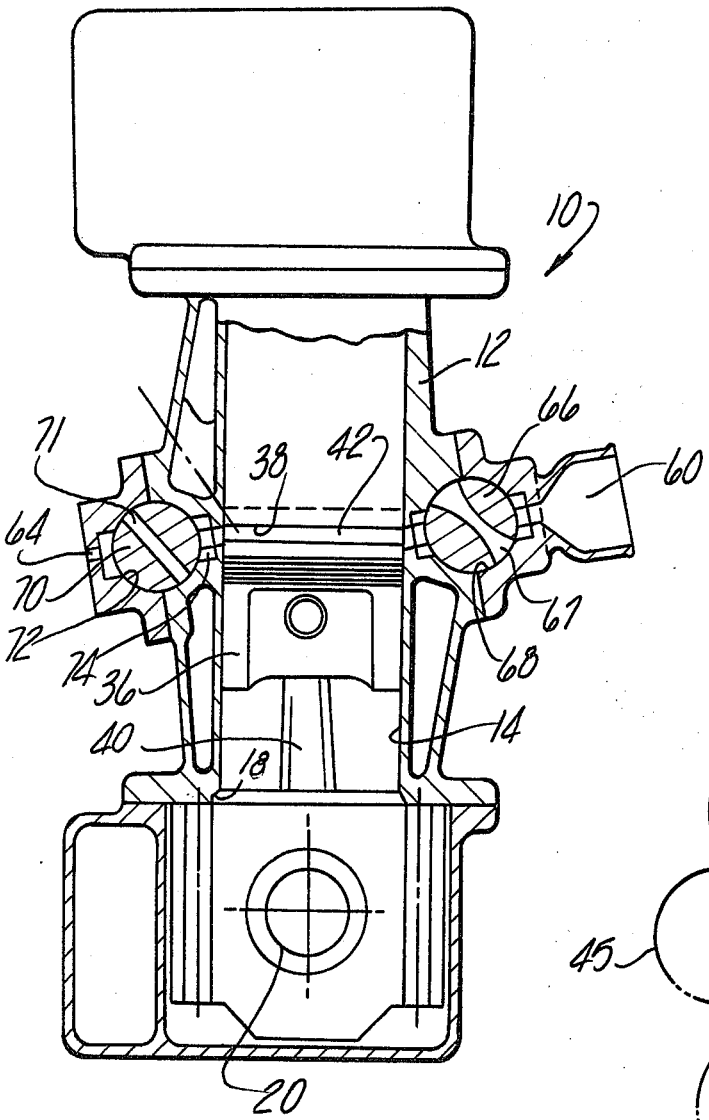
FIG. 2 is an axial plan view of the internal combustion engine according to the present invention and with parts removed for clarity.

With reference first to FIGS. 1 and 2, the internal combustion engine 10 according to the present invention is thereshown and comprises a housing or cylinder block 12 having two engine cylinders 14 formed therethrough in a side-by-side parallel relationship. Both the upper end 16 and the lower end 18 of each cylinder 14 are open in the housing 12.

A first crankshaft 20 is rotatably mounted by end bearings 22 and 24 and a central bearing 23 to the housing 12 so that the crankshaft 20 rotates by an axis perpendicular to and in line with the longitudinal axis of the cylinders 14. The bearing 23 is preferably a plain bearing of the type commonly employed in internal combustion engines and which is secured to the housing 12 by bolts 23'. The crankshaft 20 includes two crankpins 26, one of which is in alignment with each cylinder 14, and which are spaced 180° from each other. A second crankshaft 28 is similarly rotatably mounted by end bearings 30 and 32 and a center plain bearing 31 to the housing 12 adjacent the other axial end 16 of the cylinders 14. The second crankshaft 28 likewise includes a pair of throws 34, spaced 180° from each other, and the crankshaft 28 rotates about an axis perpendicular to and in line with the longitudinal axis of the cylinders 14.

As is best shown in FIG. 2, a pair of substantially identical piston members 36 are slidably disposed in each cylinder 14. Each piston 36 includes a head 38 at its innermost axial end and a piston connecting rod 40 which extends axially outwardly through the respective open ends 16 or 18 of the cylinder 14. The piston connecting rods 40 are connected in the usual fashion to their respective crankpin 26 or 34 on the crankshaft 20 or 28.

As thus far described, it can be seen that the internal combustion engine 10 according to the present invention is an opposed piston engine in which a combustion chamber 42 is formed substantially along each cylinder 14 and between the heads 38 of the pistons 36. The pistons 36 furthermore reciprocate away from and toward each other within the cylinder 14 and, in doing so, rotatably drive the crankshafts 20 and 28.

Figure 4:
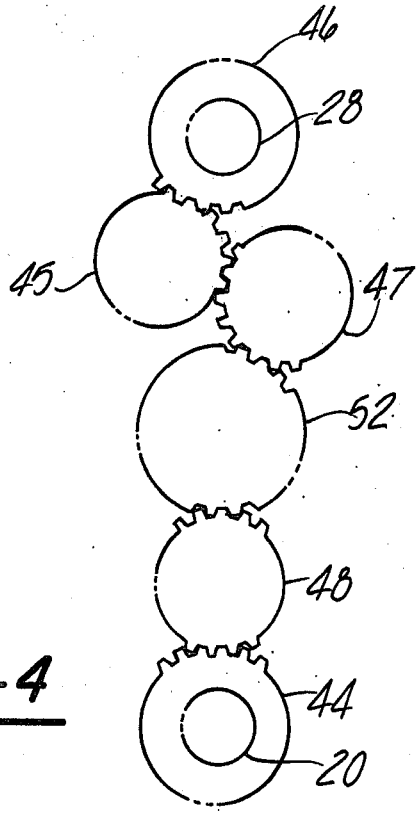
FIG. 4 is a schematic view illustrating the gearing arrangement for the internal combustion engine of the present invention.

With reference now to FIGS. 1 and 4, each crankshaft 20 and 28 includes a pinion 44 and 46, respectively, secured at its rear end 53. The crankshaft pinion 44 meshes with and rotatably drives an idler gear 48. The idler gear 48, in turn, rotatably drives a stub output shaft 52 rotatably mounted by bearings 54 to the rear end 53 of the housing 12 and having external gear teeth 56.

Still referring to FIGS. 1 and 4, the other crankshaft pinion 46 also rotatably drives the stub output shaft 52 but, instead of a single idler gear, two idler gears 45 and 47 are operatively disposed between the crankshaft pinion 46 and the stub output shaft 52. The idler gears 45 and 47 are symmetrically positioned on opposite sides of a centerline extending between the crankshafts 20 and 28 and synchronize the rotation of the crankshafts in the opposite rotational direction. The opposite rotation of the crankshafts 20 and 28 counterbalance the inertial forces of the crankshafts 20 and 28 for minimum engine vibration.

Figure 5:
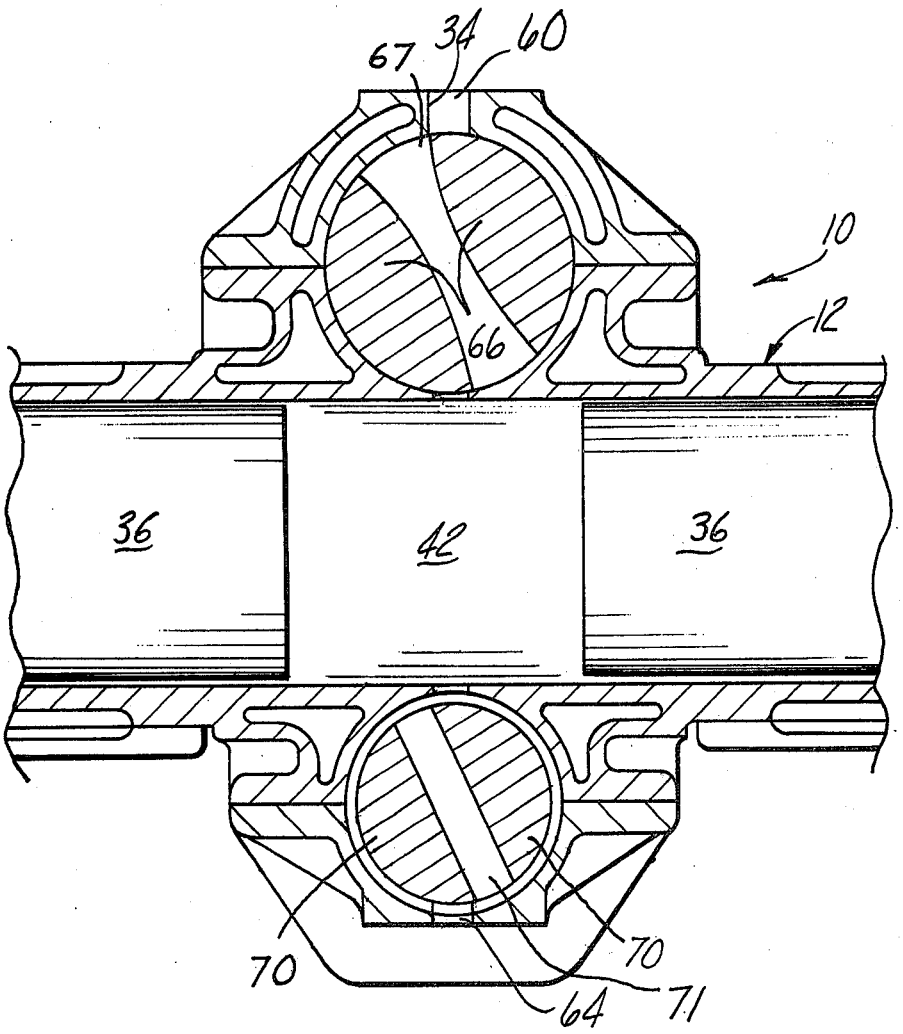
FIG. 5 is a fragmentary sectional view illustrating the operation of the internal combustion engine of the present invention.

With reference now to FIGS. 2 and 5, the engine 10 includes an intake passageway 60 for supplying fuel and/or fuel air mixture to the combustion chamber 42 and similarly includes an exhaust passageway 64 for exhausting the combustion products from the combustion chamber 42 exteriorly of the engine 10.

An intake rotary valve 66, which is elongated and cylindrical in shape, is rotatably mounted within a bore 68 in the housing 12 so that the rotary valve 66 is within the intake passageway 60 and adjacent the combustion chamber 42. Similarly, an exhaust rotary valve 70 is rotatably mounted within a bore 72 in the housing 12 within the exhaust passageway 64 and adjacent the combustion chamber 42. The valves 66 and 70 are rotatable about an axis parallel with the crankshaft axis and are preferably positioned on diametrically opposed sides of the cylinder 14. In addition, each of the rotary valves 66 and 70 includes a diametric throughbore 67 and 71, respectively, which selectively opens and closes the intake and exhaust passageways 60 and 64 in dependence upon the rotational position of the rotary valves 66 and 70. The rotary valves 66 and 70 can be of either solid or tubular construction and preferably include suitable seals 74 to prevent gas leakage along the valves 66 and 70.

Figure 6:
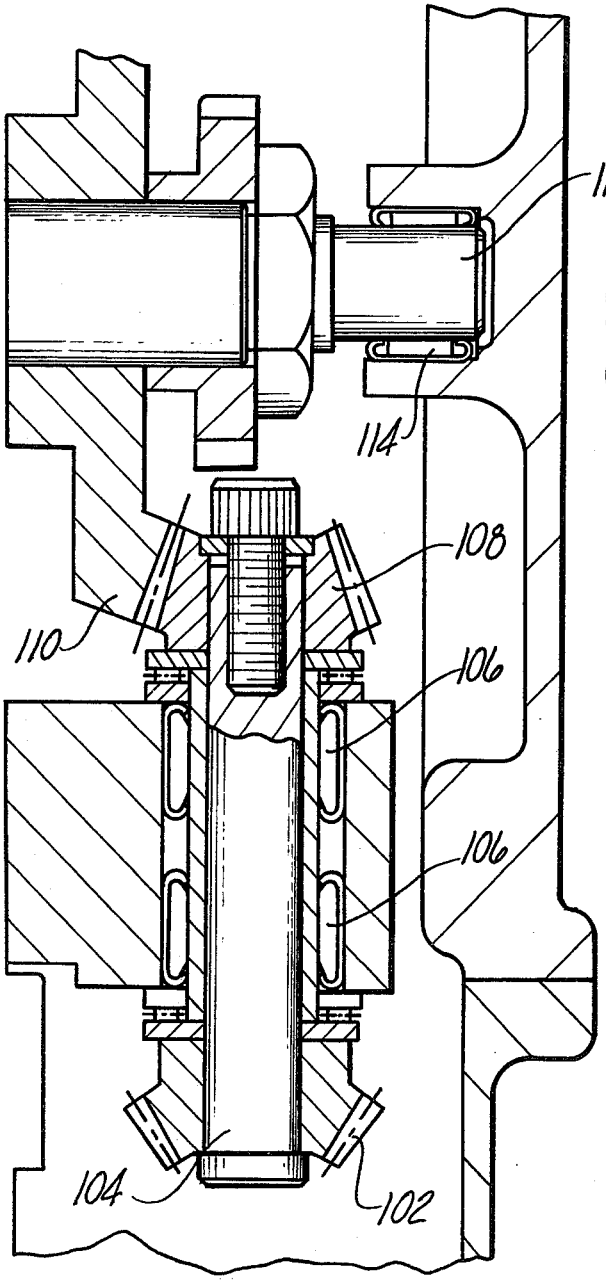
FIG. 6 is a fragmentary view taken substantially along line 6—6 in FIG. 1.
Figure 7:
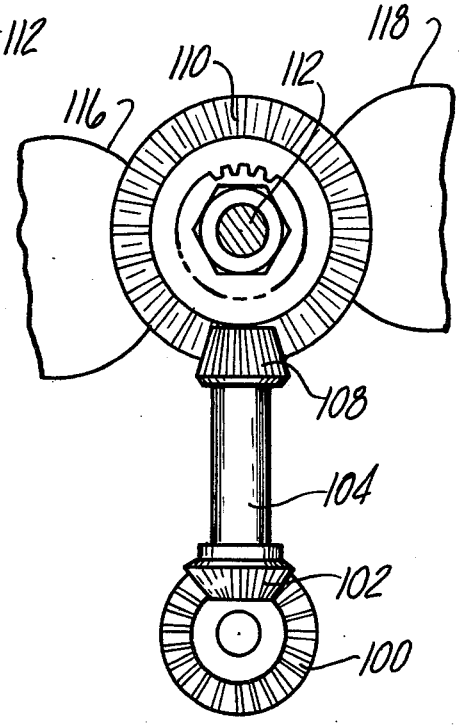
FIG. 7 is a side view of a gearing arrangement for driving the rotary valves.

With reference now to FIGS. 1 and 6, a bevel gear 100 is secured to the front end of each crankshaft 20 and 28. Each bevel gear 100 meshes with a cooperating bevel gear 102 secured at one end of a shaft 104 rotatably mounted by bearings 106 to the housing 12 and extending in a direction parallel to the cylinders 14. A further bevel gear 108 is secured to the opposite end of the shaft 104 which meshes with and rotatably drives a bevel gear 110 secured to a stub shaft 112 rotatably mounted by bearings 114 to the front of the engine housing 12 and generally coaxial with the output shaft 52. With reference now also to FIG. 7, the stub shaft bevel gear 110 in turn meshes with and rotatably drives a gear 116 secured to the front end of the exhaust rotary valve 70 and likewise drives a gear 118 secured to the front end of the intake rotary valve 66.

In order to synchronize the rotation of the valves 70 and 66 with the rotation of the crankshafts and moreover, since the exhaust and intake passageway are open only once during each two revolutions of the crankshaft and, since each valve, 70 and 66 opens its respective passageway at two rotational positions, the valves 70 and 66 are rotatably driven at a speed equal to one-fourth the rotational speed of the crankshafts. Therefore, due to the relatively low rotational speeds of the rotary valves 66 and 70, only minimal lubrication of the rotary valves 66 and 70 is required in order to prevent over heating of the rotary valves.

Figure 3:
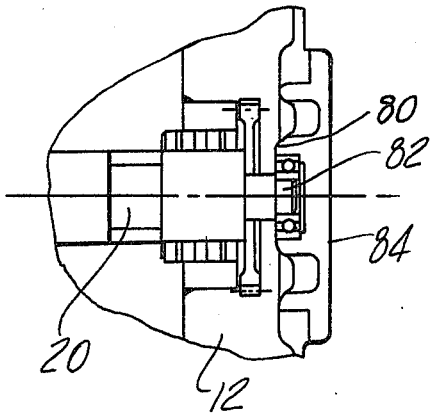
FIG. 3 is a fragmentary sectional view illustrating one portion of the internal combustion engine of the present invention.

With reference now to FIG. 3, a modification of the engine is thereshown in which one crankshaft 20 is axially extended at one end so that it protrudes outwardly from the exterior surface 80 of the housing 12. In this fashion, the outer axial end 82 of the crankshaft 20 forms a convenient power takeoff for the engine in order to power accessary drives and/or the like. Preferably a cap 84 is attached to the housing 12 and covers the crankshaft end 82 when the power takeoff is not required.

It can, therefore, be seen that the internal combustion engine according to the present invention provides a novel opposed piston engine having a rotary intake and exhaust valves. Moreover, synchronism between the dual crankshafts and the rotary valves is precisely maintained by the gearing arrangement between the crankshaft ends. It will also be understood that even though the internal combustion engine 10 has been thus far described as having two cylinders, the engine 10 can have one or more cylinders while remaining within the scope and intent of the invention.

This four-cycle, opposed piston, twin crankshaft, engine may be designed to operate as either a spark-ignition engine or as a diesel engine. This is made possible by the utilization of the rotary valves with the opposed piston engine which unlike poppet valves, do not interfere with the stroke of the pistons within each cylinder.

Having described my invention, however, many modifications thereto will become apparent to those skilled in the art to which it pertains without deviating from the spirit of the invention as defined by the scope of the appended claims.

I claim:

1. An internal combusion engine comprising:

a housing, said housing having a cylindrical bore formed therethrough;

a pair of piston members, each piston member having a head at one end and connecting means secured to the other end, said piston members being slidably disposed in said housing throughbore so that said piston heads are in a facing relationship;

fuel inlet passage means in said housing for communicating a combustible fuel to said throughbore and between said piston heads and exhaust passage means in said housing for exhausting fumes from said throughbore;

crankshaft means rotatably mounted in said housing, said connecting means being attached to said crankshaft means to rotatably drive said crankshaft means upon reciprocation of said piston members in said throughbore;

a cylindrical inlet valve member rotatably mounted in said housing adjacent said throughbore and in said fuel inlet passage means, said inlet valve member having a diametric throughbore which selectively opens and closes said inlet passage means in dependence upon the rotational position of said inlet valve member;

a cylindrical outlet valve member rotatably mounted in said housing adjacent said throughbore and in said exhaust passageway, said outlet valve having a diametric throughbore which selectively opens and closes said exhaust passageway in dependence upon the rotational position of said outlet valve member; and means for rotatably driving said valve members in synchronism with the reciprocation of the piston members in the housing throughbore, wherein said crankshaft means further comprises a pair of crankshafts rotatably mounted in said housing in a spaced and parallel relationship, one crankshaft being positioned adjacent each axial end of the housing throughbore, and means for drivingly connecting said crankshaft in synchronism to an output shaft, wherein said rotatably driving means is operatively connected between one end of at least one crankshaft and one end of said valve members, and wherein said rotatable driving means further comprises a valve drive shaft rotatably mounted in said housing, first bevel gear means for rotatably driving one end of the valve drive shaft from one end of one crankshaft and second bevel gear means for rotatably driving said valve members from the other end of said valve drive shaft.

2. The invention as defined in claim 1 wherein said drivingly connecting means further comprises a single pinion rotatably mounted to said housing and operatively disposed between one crankshaft and the output shaft and a pair of pinions rotatably mounted to said housing and operatively disposed between the other crankshaft and the output shaft whereby said crankshafts rotate in opposite rotational directions.

3. The invention as defined in claim 1 wherein said first bevel gear means is connected to the end of the crankshaft opposite from said means for drivingly connecting said crankshaft to the output shaft.

4. The invention as defined in claim 1 and including power take off means at at least one end of at least one crankshaft.

5. The invention as defined in claim 4 wherein said power take off means further comprises a portion of said crank shaft which extends outwardly and exteriorly of said housing.

6. An internal combustion engine comprising:

a housing, said housing having a cylinder wall forming a cylindrical bore therethrough;

a pair of piston members, each piston member having a head at one end and connecting means secured to the other end, said piston members being slidably disposed in said housing throughbore so that said piston heads are in a facing relationship and a combustion chamber is formed by said cylinder wall between said pistons;

fuel inlet passage means in said housing on one side of said pistons for communicating a combustible fuel to said throughbore and between said piston heads and exhaust passage means in said housing on the opposite side of said pistons and communicating with said throughbore for exhausting fumes from said throughbore;

crankshaft means rotatably mounted in said housing, said connecting means being mounted to said crankshaft means to rotatably drive said crankshaft means upon reciprocation of said piston members in said throughbore;

a cylindrical inlet valve member rotatably mounted in said housing adjacent said throughbore and in said fuel inlet passage means, said inlet valve member having a diametric throughbore which selectively opens and closes said inlet passage means in dependence upon the rotational position of said inlet valve member;

a cylindrical outlet valve member rotatably mounted in said housing adjacent said throughbore and in said exhaust passageway, said outlet valve having a diametric throughbore which selectively opens and closes said exhaust passageway in dependence upon the rotational position of said outlet valve member; and means connected to said valve member for rotatably driving said valve members in synchronism with the reciprocation of the piston members in the housing throughbore.

* * * * *